US008946604B2

(12) United States Patent
Kaiser et al.

(10) Patent No.: US 8,946,604 B2
(45) Date of Patent: Feb. 3, 2015

(54) COOKING OVEN WITH AT LEAST ONE CONVECTION HEATING DEVICE

(75) Inventors: Kersten Kaiser, Rothenburg o.d. Tauber (DE); Karl Leidig, Insingen (DE); Reiner Horstmann, Guxhagen (DE)

(73) Assignee: Electrolux Home Products Corporation, Brussels (BE)

( * ) Notice: Subject to any disclaimer, the term of this patent is extended or adjusted under 35 U.S.C. 154(b) by 16 days.

(21) Appl. No.: 13/376,460

(22) PCT Filed: Jun. 23, 2010

(86) PCT No.: PCT/EP2010/003771

§ 371 (c)(1), (2), (4) Date: Dec. 6, 2011

(87) PCT Pub. No.: WO2011/006578

PCT Pub. Date: Jan. 20, 2011

(65) Prior Publication Data

US 2012/0103318 A1 May 3, 2012

(30) Foreign Application Priority Data

Jul. 15, 2009 (EP) ..... 09009201

(51) Int. Cl.
*H05B 6/64* (2006.01)
*F24C 15/32* (2006.01)

(52) U.S. Cl.
CPC ..... *F24C 15/327* (2013.01)
USPC ..... 219/681

(58) Field of Classification Search
CPC ..... F24C 15/327; F24C 15/322; F24C 15/34
USPC ..... 219/200, 385, 391, 399, 400, 401, 409, 219/411, 412, 413, 482, 490, 492, 678, 680, 219/681, 682, 685, 756, 757; 126/1, 1 R, 126/19 R, 20, 21 R, 21 A; 99/324, 325, 330, 99/331, 447, 451, 467, 473, 474, 475, 476, 99/482, 483
See application file for complete search history.

(56) References Cited

U.S. PATENT DOCUMENTS

| | | | |
|---|---|---|---|
| 2003/0217645 | A1 | 11/2003 | Jones et al. |
| 2004/0026401 | A1 | 2/2004 | Jones et al. |
| 2004/0040950 | A1 | 3/2004 | Carbone et al. |

FOREIGN PATENT DOCUMENTS

| | | |
|---|---|---|
| DE | 2043546 | 3/1972 |
| DE | 10236961 | 2/2004 |
| EP | 1616516 | 1/2006 |
| EP | 1780471 | 5/2007 |
| EP | 1790913 | 5/2007 |

OTHER PUBLICATIONS

International Search Report for PCT/EP2010/003771, dated Nov. 19, 2010, 3 pages.

*Primary Examiner* — Dana Ross
*Assistant Examiner* — Joseph Iskra
(74) *Attorney, Agent, or Firm* — Pearne & Gordon LLP

(57) ABSTRACT

The present invention relates to a cooking oven with at least one convection heating device (20). The convection heating device (20) is arranged in a rear wall (16) of the oven cavity (10). The convection heating device (20) includes at least two fans (26) and at least one ring element (28). The fans (22) are arranged side-by-side at the rear wall (16). A steam generator is provided for generating steam. At least two steam injectors (30) are provided, wherein each steam injector (30) corresponds with at least one fan (26). The steam injector (30) is directed along the radial axis of the corresponding fan (26), so that the steam is injected along the radial axis of said fan (26).

11 Claims, 1 Drawing Sheet

COOKING OVEN WITH AT LEAST ONE CONVECTION HEATING DEVICE

Figure 1:
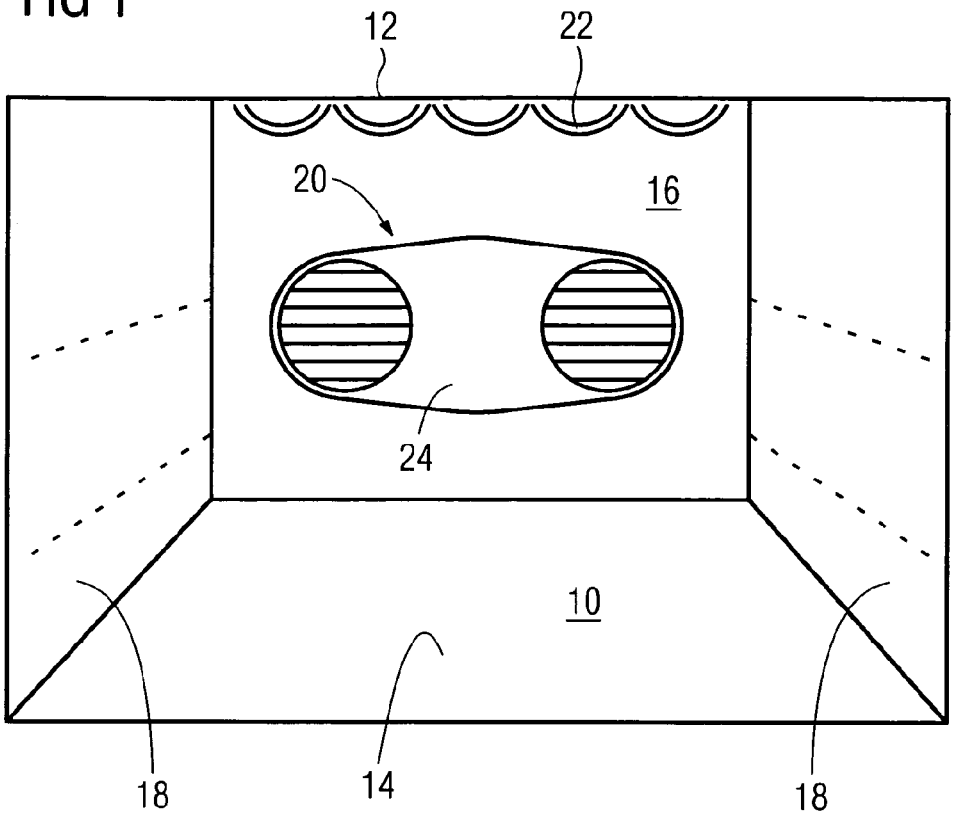

The present invention relates to a cooking oven with at least one convection heating device according to claim 1.

Cooking ovens, in particular for household appliances, comprising conventional heating elements in combination with microwave appliances are well known. The conventional heating elements may be radiant and convection heaters, for example. The combinations of conventional heating elements and microwave appliances allow methods for speeding up the cooking process.

Most of the convection heating systems comprise a ring element, a fan and a fan cover. The ring element, the fan and the fan cover are located in the rear wall of the oven cavity. Such convection heating systems are known as single fan systems. However, the air ventilation in these convection heating systems is limited. Thus, the heat distribution is not optimized.

US 2004/0040950 A1 discloses a convection oven with forced air-flow circulation zones. The circulation zones are created by two fans arranged side-by-side in the rear wall of the oven cavity. Each fan corresponds with one heating element. The substantially horizontal airflow reduces the non-uniformity of the air temperature distribution within the oven cavity.

DE 2 043 546 A1 describes a circulating air oven for canteen kitchen or large-scale catering establishments. The oven comprises a fan and a spray nozzle. The spray nozzle injects water in order to increase the humidity. The spray nozzle injects the water along an axial direction with respect to the fan.

It is an object of the present invention to provide a cooking oven with at least one convection heating device, which allows an improved heat distribution in the oven cavity.

The object of the present invention is achieved by the cooking oven according to claim 1.

According to the present invention the cooking oven comprises at least one convection heating device (20), wherein:

- the convection heating device is arranged in a rear wall of the oven cavity,
- the convection heating device includes at least two fans and at least one ring element,
- the fans are arranged side-by-side at the rear wall,
- a steam generator is provided for generating steam,
- at least two steam injectors are connected to the steam generator,
- each steam injector corresponds with at least one fan, and
- the steam injector is directed along the radial axis of the corresponding fan, so that the steam is injected along said radial axis towards the fan.

The main idea of the present invention is the double fan system with the injected steam between the fan blades of said double fan system, wherein the steam is injected along a radial direction on respect of the fan. This constellation allows a more even heat distribution within the oven cavity. The heat transfer to the food stuff is increased. The heating up time of the empty oven cavity is reduced. The steam increases the cooking speed and the quality of the food stuff.

According to the preferred embodiment of the present invention the cooking oven comprises at least one microwave appliance. The combination of the convection heating device and the microwave appliance allows methods for speeding up the cooking process.

In particular, the ring element encloses circumferentially the at least two fans. This structure allows an efficient transfer of the heat generated by the ring element.

Preferably, at least a part of the steam injectors is arranged between the fans. This constellation allows a very compact convection heating device.

Further, the steam injectors may be arranged in such a way, that the steam is injected to the blades of the fans.

For example, the convection heating device may be covered by a cover element from the side of the oven cavity.

Additionally, the cooking oven may comprise at least one radiant heating element. Thereby the at least one radiant heating element may be arranged below the top wall and/or above the bottom wall of the oven cavity.

Further, the fans may be enclosed by one common ring element. This contributes to a compact structure.

At last, all the steam injectors may be arranged between the fans. Also this aspect contributes to the compact structure of the convection heating device.

The novel and inventive features believed to be the characteristic of the present invention are set forth in the appended claims.

Figure 2:
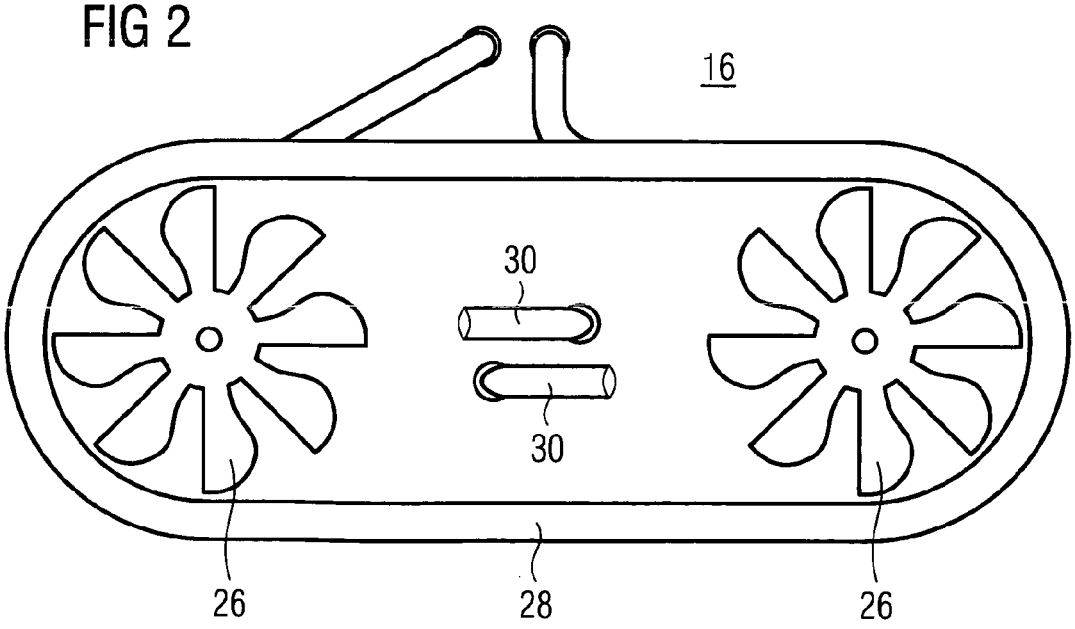

The invention will be described in further detail with reference to the drawings, in which FIG. 1 illustrates a schematic diagram of a perspective front view of an oven cavity of a cooking with a convection heating device and a radiant heating element according to a preferred embodiment of the present invention, and FIG. 2 illustrates a schematic diagram of a detailed front view of the convection heating device at the rear wall of the oven cavity according to the preferred embodiment of the present invention.

FIG. 1 illustrates a schematic diagram of a perspective front view of an oven cavity 10 of a cooking oven with a convection heating device 20 and a radiant heating element 22 according to a preferred embodiment of the present invention.

The oven cavity 10 is bordered by a top wall 12, a bottom wall 14, a rear wall 16 and two side walls 18. In the rear wall 16 of the oven cavity 10 the convection heating device 20 is arranged. The convection heating device 20 is covered by a cover element 24. Below the top wall 12 of the oven cavity 10 the radiant heating element 22 is arranged. Further, the cooking oven comprises a microwave appliance, which is not explicitly shown on FIG. 1.

The heat transfer from the convection heating device 20 to the oven cavity 10 is carried out by heat convection. The heat transfer from the radiant heating element 22 to the oven cavity 10 occurs by heat radiation.

FIG. 2 illustrates a schematic diagram of a detailed front view of the convection heating device 20 arranged at the rear wall 16 of the oven cavity 10 according to the preferred embodiment of the present invention. The cover element 24 is demounted in FIG. 2.

The convection heating device 20 comprises two fans 26, a ring element 28 and two steam injectors 30. The both fans 26 are arranged side-by-side at the rear wall 16 of the oven cavity 10.

The fans 16 generate an air flow from the rear wall 16 into the interior of the oven cavity.

The ring element 28 encloses circumferentially the both fans 26. In this example, the ring element 28 includes two loops enclosing circumferentially the fans 26. Alternatively, the ring element 28 may include one loop as well as more than two loops enclosing circumferentially the fans 26.

The steam injectors 30 are arranged at the rear wall 16 between the fans 26 and inside of the ring element 28. The steam injectors 30 are connected to a steam generator, which is not shown. The steam generator is provided to generate steam.

Each of the steam injectors 30 corresponds with one of the fans 26. The upper steam injector 30 in FIG. 2 corresponds with the fan 26 on the left hand side and injects the steam from right to left. The lower steam injector 30 in FIG. 2 corresponds with the fan 26 on the right hand side and injects the steam from left to right.

The ring element 28 generates heat by electric energy. The air flow generated by the fans 26 transfers the heat into the interior of the oven cavity 10. The fans 26 allow a heat transfer with a high speed.

The steam injectors 30 inject the steam to the fans 26 along a radial direction in respect of the fans 26. This direction allows an even distribution of the steam.

The cooking oven comprises additionally a microwave appliance. The combination of the convection heating device 20, the microwave appliance and/or the radiant heating element 22 allows a faster cooking process and a reduction of the cooking time. Further, the cooking oven according to the present invention allows a substantially equal heat distribution in the oven cavity 10.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven cavity
12 top wall
14 bottom wall
16 rear wall
18 side wall
20 convection heating device
22 radiant heating element
24 cover element
26 fan
28 ring element
30 steam injector

The invention claimed is:

1. A cooking oven with at least one convection heating device (20), wherein:

the convection heating device (20) is arranged in a rear wall (16) of the oven cavity (10), the convection heating device (20) includes a first fan (26) and a second fan (26) and at least one ring element (28), the first fan (26) and the second fan (26) are arranged side-by-side at the rear wall (16) such that a rotational axis of the first fan (26) and a rotational axis of the second fan (26) are horizontally spaced and coplanar, a steam generator is provided for generating steam, a first steam injector (30) and a second steam injector (30), wherein the first steam injector (30) and second steam injector (30) are connected to the steam generator, the first steam injector (30) corresponds with the first fan (26) and the second steam injector (30) corresponds with the second fan (26), the first steam injector (30) is directed along a first radial axis of the first fan (26), so that the steam is injected in a first horizontal direction along said first radial axis towards the first fan (26), the second steam injector (30) is directed along a second radial axis of the second fan (26), so that the steam is injected in a second horizontal direction opposite the first horizontal direction and along said second radial axis towards the second fan (26), the first steam injector (30) and the second steam injector (30) are both arranged between the first fan (26) and the second fan (26) such that the first steam injector (30) is vertically spaced from and extends parallel to the second steam injector (30), and the ring element (28) is configured to generate heat and completely circumscribes the first fan (26) and the second fan (26).

2. The cooking oven according to claim 1, characterized in, that the cooking oven comprises at least one microwave appliance.

3. The cooking oven according to claim 1, characterized in, that at least a part of the first steam injector (30) and at least a part of the second steam injector (30) are arranged between the fans (26).

4. The cooking oven according to claim 1, characterized in, that the first steam injector (30) and the second steam injector (30) are arranged in such a way, that the steam is injected to the blades of the first fan (26) and the second fan (26).

5. The cooking oven according to claim 1, characterized in, that the convection heating device (20) is covered by a cover element (24) from the side of the oven cavity (10).

6. The cooking oven according to claim 1, characterized in, that the cooking oven comprises at least one radiant heating element (22).

7. The cooking oven according to claim 1, characterized in, that the at least one radiant heating element (22) is arranged below the top wall (12) and above the bottom wall (14) of the oven cavity (10).

8. The cooking oven according to claim 1, characterized in, that the first fan (26) and the second fan (26) are enclosed by one common ring element (28).

9. The cooking oven according to claim 1, wherein an outlet of the first steam injector is adjacent to an inlet of the second steam injector.

10. The cooking oven according to claim 1, wherein an outlet of the first steam injector is closer to an inlet of the second steam injector than to an outlet of the second steam injector.

11. The cooking oven according to claim 1, wherein an outlet of the first steam injector is vertically aligned with an inlet of the second steam injector and an outlet of the second steam injector is vertically aligned with an inlet of the first steam injector.

* * * * *